United States Patent [19]

Dittmar

[11] Patent Number: 4,724,375

[45] Date of Patent: Feb. 9, 1988

[54] SELECTABLE DIRECT CURRENT POWER SUPPLY

[76] Inventor: Norman R. Dittmar, 525 5th Ave. N.W., Rochester, Minn. 55901

[21] Appl. No.: 929,815

[22] Filed: Nov. 12, 1986

[51] Int. Cl.[4] ..... G05F 1/44

[52] U.S. Cl. ..... 323/275; 340/662; 340/663

[58] Field of Search ..... 323/274, 275, 280, 281; 340/660, 661, 662, 663

[56] References Cited

U.S. PATENT DOCUMENTS 4,413,226 11/1983 Davies ..... 323/273 X

FOREIGN PATENT DOCUMENTS 0154019 9/1983 Japan ..... 323/281

OTHER PUBLICATIONS

Linear Data Book, National Semiconductor Corp., 1978, pp. 1-96, 100, 101, and 3-153.

Linear Integrated Circuits, RCA Corp., 1980, p. 280.

Electronic Design 6, John Okolowicz, "Automotive charging regulator gives overvoltage and undervoltage warnings", 3/76.

Electronics Today International, Ray Marston, "The LM10 Applications", 10/79, p. 70.

*Primary Examiner*—Patrick R. Salce

*Assistant Examiner*—Kristine Peckman

[57] ABSTRACT

A direct current power supply configuration for use in a wide variety of electronics applications, is described. The invention features high precision capability with relatively simple circuitry. A system of panel indicators eliminates the need for a panel voltmeter and improves serviceability and ease of operation over the prior art.

2 Claims, 2 Drawing Figures

SELECTABLE DIRECT CURRENT POWER SUPPLY

REFERENCES CITED

U.S. Pat. No. 4,413,226 to R. B. Davies, "Voltage Regulator Circuit", filed February 1982, Int. Cl. G05F 1/56 U.S. Cl. 323/(273,303,316)

Other Publications Cited:

Linear Data Book, National Semiconductor Corp., 2900 Semiconductor Drive, Santa Clara, Calif. 95051, pp 1–96, 100, 101, and 3–153. (1978).

Linear Integrated Circuits, RCA Corp., 1980, Data for type number CA3130, pp 280, ff.

BACKGROUND OF THE INVENTION

The need for a device which provides a source of direct current electricity is well known throughout the electronics world, especially in the telecommunications, chemical, automotive, and computer industries, and in research and development laboratories of diverse types. Any such device is generally termed a direct current power supply; it may stand alone as an instrument, or it may incorporated inside some system.

The present invention is a dc power supply configuration of the voltage regulating type. It has been implemented using linear integrated circuits and a few discrete components.

Integrated circuits have been invented for power supply applications wherein a high degree of regulation, low cost, noise rejection, output current limitation, and ease of implementation have been achieved. The industry standard type number LM723, described in the LINEAR DATA BOOK cited above, p 1–96, is one such circuit. Complete power circuit configurations are given on pp 1–99 & 1–100 of this reference. Another such integrated circuit is described in U.S. Pat. No. 4,413,226.

Power supplies which can produce a regulated emf between zero and two volts have been invented and are now particularly easy to implement using zero sensing operational amplifiers, such as the industry standard type #LM2904 (Linear Data Book, op cit, p 3–153), which is a junction transistor integrated circuit device. (An operational amplifier is herein said to be zero sensing if it can function with a common mode input emf equal to the most negative emf in the amplifier). Similar applications have been made of a recently developed integrated circuit employing field effect transistors. (LINEAR INTEGRATED CIRCUITS, loc cit, Type #CA3130, p 280).

In all of the aforementioned power supply circuits there remain the problems of errors due to input offsets intrinsic to the operational amplifiers and no provision for indicating to the operator when the power supply is not really delivering to its output terminal the voltage selected by the operator.

SUMMARY OF THE INVENTION

The purpose of the present invention is to provide an accurately selectable source of direct current emf for the wide variety of laboratory and other electronics related applications, to eliminate any need for a panel voltmeter, and to provide a system employing panel indicators which provide information to the operator concerning the condition of the regulation circuitry internal to the device.

The advantages of the present invention over the prior art are:

(a) Neither an output monitoring panel voltmeter nor an attendant range switch is needed.

(b) The input offset voltage of each of the four operational amplifiers employed is cancelled during the calibration procedure for the configuration.

(c) Diagnostic information concerning the regulation circuitry is provided by panel indicators, which are relatively easy to interpret. These tell whether regulation has been lost, whether oscillatory behavior is occurring, whether transient output deviation are occurring, and, in the case where there is an output current limiter, they indicate the onset of that function.

The present invention features a unique circuit configuration to exploit the potential accuracy that high gain operational amplifiers can afford, if the circuit can provide electronic conditions favorable to them.

The invention comprises an input terminal for unregulated direct current, two sources of fixed emf (reference voltages), 14 & 31 in FIG. 1, an interfacing operational amplifier, a main regulating operational amplifier 6, and a dc power amplifier 9. A precision resistance dividing element, hereinafter called a potentiometer, together with the first voltage reference 14, generate an emf which is to determine the voltage at the device output terminal 10.

The interfacing operational amplifier 4 senses the device output emf, compares it with the emf selected by the potentiometer 11, and generates a correction emf for the main amplifier 6. The voltage gain of the interface amplifier 4 is meant to be fixed at approximately two at the positive (noninverting) input terminal 3. This gain may be anything between one and ten, but the amplifier output is always near the second reference voltage, which is chosen to be well within the common mode range of the main amplifier 6.

The main amplifier 6 is operated without feedback and would react sharply to any perturbation at the device output terminal which is transmitted to net 5 through the calibration resistor 15 via interface amplifier 4. But a capacitor 8 on its output terminal condenses transients and prevents any precipitous signal from going into the power amplifier 9.

The power amplifier 9 is intended to be mainly a current boosting dc amplifier. It should have a voltage gain of approximately 1.2, but any gain between 0.8 and 10 is applicable to the invention.

The invention further comprises a pair of operational amplifiers, the first of which 25 causes a panel indicator 27 to act if the power supply is overloaded, and the second 28 causes a second panel indicator 30 to act if the regulation circuitry is unable to hold back the unregulated dc emf for any reason.

In normal operation the main amplifier 6 and the two sensing operational amplifiers 25 & 28 are always operating with a common mode voltage nearly equal to that of the second reference source 31. Therefore, if the input offset voltages of each of these amplifiers is cancelled by other circuit elements, then any attendant errors in output emf will be eleminated over the entire range of operation of the power supply.

It has also been found that the input offset voltage of the interfacing amplifier 4 can be compensated for over the entire range of operation of the power supply.

Because of the precision capability of even a simple version of the invention, the panel indicators 25 & 28 generally act before any movement could be perceived on a panel voltmeter.

DETAILED DESCRIPTION OF THE PREFERRED EMBODIMENTS

Figure 1:
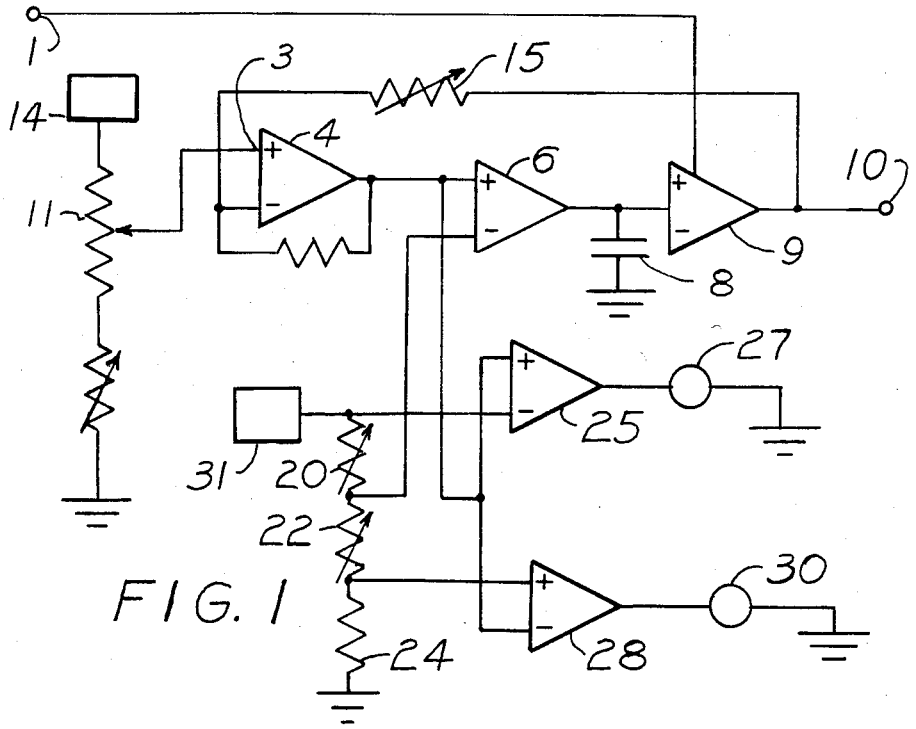
FIG. 1 symbolizes all the elements of the invention. It represents the invention.
Figure 2:
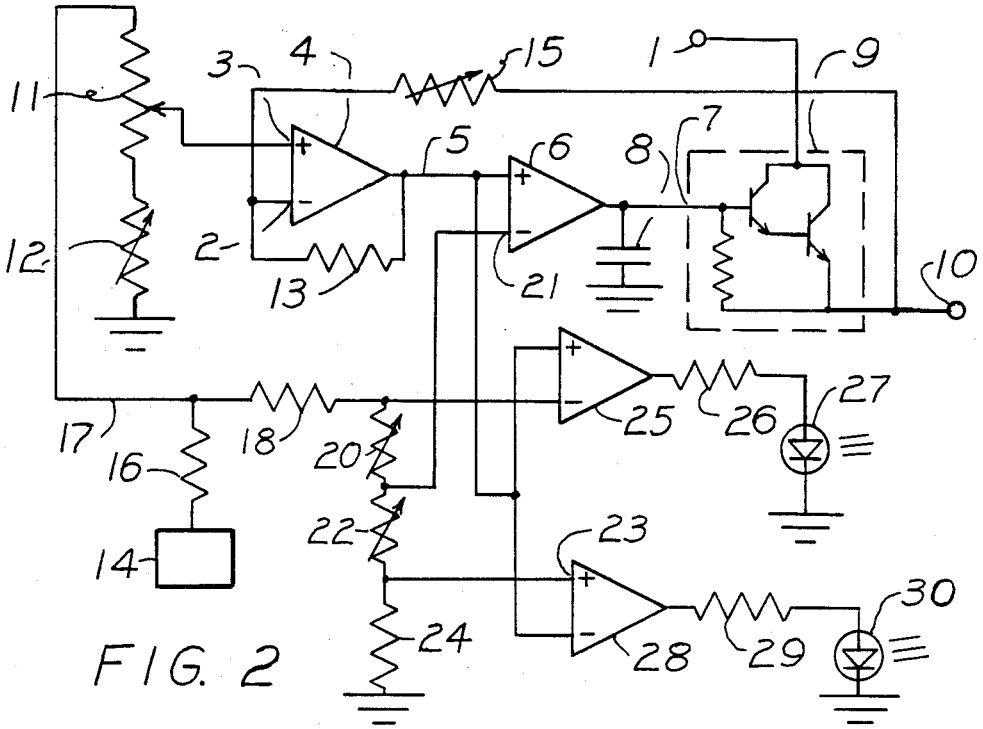
FIG. 2 represents a preferred embodiment of the invention.

The function and fabrication of the invention are now described in more technical detail and with more specific components than in the SUMMARY above. Please refer to FIG. 2.

During normal operation of the present invention, the differential voltage on the respective inputs of each operational amplifier is very small and is less than the maximum voltage at the output terminal 10, reduced by a factor equal to the open loop voltage gain of each operational amplifier, respectively.

In the preferred embodiment the interface operational amplifier 4 and the sensing operational amplifiers 25 & 28 are all inside one integrated circuit unit, which is an industry standard type number LM2902. The open loop voltage gain for each said amplifier is typically 100,000.

The main operational regulating amplifier 6 is an industry standard type #LM723 integrated circuit unit.

The output from the present invention, which appears at terminal 10, is sensed by the interfacing operational amplifier 4 operating as a differential input dc feedback amplifier. Its gain is determined by the feedback resistor 13 and the calibration resistor 15.

The desired device output voltage is selected by turning the dial (not shown) on the potentiometer 11, which is a Bourns model #3610S-1-203 in the present embodiment. The corresponding emf on the slider terminal of the potentiometer is applied to the positive (noninverting) input terminal 3 of amplifier 4.

If the voltage at device output terminal 10 is smaller than the selected voltage, the emf on the negative (inverting) terminal 2 of amplifier 4 is reduced, the emf on net 5 is quickly increased by amplifier 4, and the emf on the base connection 7 of amplifier 9 is also increased by amplifier 6. Amplifier 9 then increases the emf at terminal 10 until the selected voltage has been attained there. The capacitor 8 prevents the emf at the input terminal 7 of the amplifier 9 from either increasing or decreasing so rapidly as to destabilize the overall circuit.

Conversely, if the voltage at the output terminal 10 is larger than the voltage selected by potentiometer 11, the components named in the above paragraph all do just the opposite, and the configuration does just the opposite, in order to restore the emf at terminal 10 to the selected voltage.

The operational amplifiers 25 & 28 sense the condition of the amplifier 6 and indicate whether the emf at terminal 10 is higher or lower than the output voltage selected on the potentiometer 11. If there is a slight positive emf between net 5 and terminal 21, the power supply is being overloaded, and the amplifier 25 will cause the light emitting diode (LED) 27 to shine.

Conversely, if there is a slight negative differential voltage on the input terminals of amplifier 6, this means that the amplifier 9 is not applying a low enough voltage to the terminal 10. Then there will be a positive voltage between net 5 and the positive terminal 23 of amplifier 28, and the amplifier 28 will cause the LED 30 to shine.

The resistors 26 and 29 limit the current through the LED's 27 & 30, respectively.

The sensing amplifiers 25 & 28 may have intrinsic offset voltages at their respective inputs. The variable resistors 20 & 22 are adjusted to nullify these offset voltages. They can nullify either positive or negative offset voltages in amplifiers 25 and 28, because a slight negative biasing emf is desirable on each of the amplifiers 25 & 28, so that they will not cause the indicators 27 & 30 to act too readily.

The resistor 16 reduces the emf from that of the voltage reference 14 to the emf required as the first reference voltage at net 17.

The resistors 18 & 20 further reduce the first reference voltage to a second reference voltage, which is applied to the inverting input 21 of the main amplifier 6. The voltage on termination 21 is meant never to change. The resistance of 20 is so small that it doesn't affect the emf at 21 appreciably.

Mathematical expressions show that there exists a value for resistor 12 such that the output voltage at 10 will be zero volt when the selection potentiometer 11 is at minimum rotation and that any value within the capability of the power amplifier 9 may be chosen for the output voltage at 10, for the maximum rotation of the potentiometer 11.

The values of resistance for the resistors 11, 12, 13, 15, 18, 20, 22, and 24, respectively, are chosen as follows:

1. The maximum device output voltage is chosen. This is ten volts in the preferred embodiment.
2. A value for the first reference voltage, say $V_1$, is computed as approx. $\frac{2}{3}$ of the maximum device output voltage. In this case seven volts was convenient.
3. The value for the second reference voltage, say $V_2$, is computed as $\frac{1}{2}$ of $V_1$. In this case $V_2=3.5$ volts.
4. The value of resistor 11 is chosen to be small enough so that the input offset current of amplifier 4 will not be significant. (The value of resistor 11 is symbolized by $R_{11}$, etc.). $R_{11}=20{,}000$ ohms.
5. $$R_{12} = \frac{Q}{1-Q} \times R_{11}, \text{ where } Q = \frac{R_{15}}{R_{13}+R_{15}} \times \frac{V_2}{V_1}$$

These yield $Q=\frac{1}{4}$, so that $R_{12}=\frac{1}{3}R_{11}$.
6. $R_{13}=1/6R_{11}$; $R_{15}=1/6R_{11}$.
7. $R_{18}=R_{24}$; $R_{18}=1/5R_{11}$.
8. $R_{20}=R_{18}/1{,}000$ $R_{24}=R_{18}$.

In other applications of the invention the basic equation, $$V_0 = \frac{V^+(R_{13}+R_{15}) - R_{15} \times V_2}{R_{13}},$$

where $V_O$ is the voltage on output terminal 10, and $V+$ is the voltage on terminal 3 of amplifier 4, may be applied to determine the values of resistors 11, 12, 13, 15, 20, 22, and 24.

Now, in the preferred embodiment the common mode voltage, Vcm, on the input of amplifier 4 goes from 1.75 to 7.0 volts as $V_O$ goes from zero to ten volts. The input offset voltage of amplifier 4 is nearly constant over this range. Therefore, if the input offset voltage is cancelled for one value of $V_{cm}$, then it is nearly cancelled for the entire range of operation of amplifier 4.

I claim:

1. A direct current power supply configuration comprising (a) a system ground which is a node of common connection for all components connected thereto, (b) a direct current (dc) power amplifier having single input, output, and power terminals, wherein the power terminal is the configuration input terminal for applying unregulated dc power, and the output terminal is the configuration output terminal, (c) a main operational amplifier having positive input, negative input, and output terminals, wherein the output terminal is connected to said input terminal of said dc power amplifier, (d) a capacitor, which is connected from said output terminal of said main operational amplifier to said system ground, (e) an interfacing operational amplifier having positive input, negative input, and output terminals, wherein the output terminal is connected to said positive input terminal of said main operational amplifier, (f) a potentiometer having an increasing terminal, slide terminal, and decreasing terminal, wherein the slide terminal is connected to said positive input terminal of said interfacing operational amplifier, (g) first and second sensing operational amplifiers, each having a positive input, negative input, and output terminal, wherein said positive input terminal of the first and the negative input terminal of the second are both connected to said positive input terminal of said main operational amplifier, (h) first and second sources of fixed emf, wherein the emf of the first is less than a maximum anticipated configuration output emf, and the emf of the second is less than the emf of the first, and wherein the first is connected to said decreasing terminal of said potentiometer, and the second is connected to said negative input terminal of said first sensing operational amplifier, (i) a first compensating variable resistor connected from said second source of fixed emf to said negative input terminal of said main operational amplifier, (j) a second compensating variable resistor connected from said negative input terminal of said main operational amplifier to said positive input terminal of said second sensing operational amplifier, (k) a dropping resistor connected from said positive input of said second sensing operational amplifier to said system ground, (l) an adjustable resistor connected from said increasing terminal of said potentiometer to said system ground, (m) a feedback resistor connected from said output terminal of said interface operational amplifier to said negative input terminal thereof, (n) an adjustable resistor for calibration connected from said configuration output terminal to said negative input terminal of said interfacing operational amplifier, (o) first and second panel light emitting means, the first connected from said output terminal of said first sensing operational amplifier to said system ground, and the second connected from said output terminal of said second sensing operational amplifier to said system ground.

2. Configuration as in claim 1, wherein the voltage gain of said dc power amplifier is between 0.8 and 10, and the open loop voltage gain of each of said interface, sensing, and main operational amplifiers, is greater than 1,000.

* * * * *